US005884956A

United States Patent [19]

Pasquin

[11] Patent Number: 5,884,956

[45] Date of Patent: Mar. 23, 1999

[54] MODIFIED RAILROAD WHEEL AND AXLE ASSEMBLY

[76] Inventor: Carl A. Pasquin, 520 Van Buren St., Pueblo, Colo. 81004

[21] Appl. No.: 889,144

[22] Filed: Jul. 7, 1997

[51] Int. Cl.[6] ..... B60B 37/12

[52] U.S. Cl. ..... 295/37; 295/44; 295/43

[58] Field of Search ..... 295/1, 10, 35, 295/36.1, 37, 44, 43

[56] References Cited

U.S. PATENT DOCUMENTS

| | | | |
|---|---|---|---|
| 686,217 | 11/1901 | Fairbanks | 295/37 |
| 751,243 | 2/1904 | Austin | 295/37 X |
| 1,164,470 | 12/1915 | Coan | 295/43 X |
| 2,106,345 | 1/1938 | Frede | 295/44 X |
| 2,488,785 | 11/1949 | Watter | 295/37 X |
| 3,802,352 | 4/1974 | Keller | 295/37 X |

FOREIGN PATENT DOCUMENTS

| | | | |
|---|---|---|---|
| 150120 | 3/1960 | U.S.S.R. | 295/43 |

*Primary Examiner*—Russell D. Stormer
*Attorney, Agent, or Firm*—Phillip A Rein

[57] ABSTRACT

A modified railroad wheel and axle assembly used to replace conventional railroad wheel and axle assemblies whereupon one end of a railroad axle assembly is machined to receive a modified railroad wheel assembly thereon. The other end of the railroad axle assembly has a conventional railroad wheel member press fit thereon in a non-rotatable condition. The invention is operable to allow one of two spaced railroad wheel members on a railroad axle assembly to be slip rotatable thereon to reduce wear and tear on a railroad wheel member and the railroad rail members on which the railroad wheel member is tracking. The modified railroad wheel assembly includes a wheel retrofit assembly having 1) a main support retainer member to be press fit on a modified end wheel support section on a railroad axle assembly; 2) a retainer washer member to be mounted about the modified end wheel support section of the railroad axle assembly and engageable with a shoulder section on the railroad axle assembly and the main support retainer section to hold the railroad wheel member therebetween; and 3) a slip bushing member mounted about a wheel retainer section on the main support retainer member and having the railroad wheel member mounted thereon to permit relative slip rotation thereon. The slip bushing member is constructed of a nylon or Teflon self-lubricating material.

4 Claims, 1 Drawing Sheet

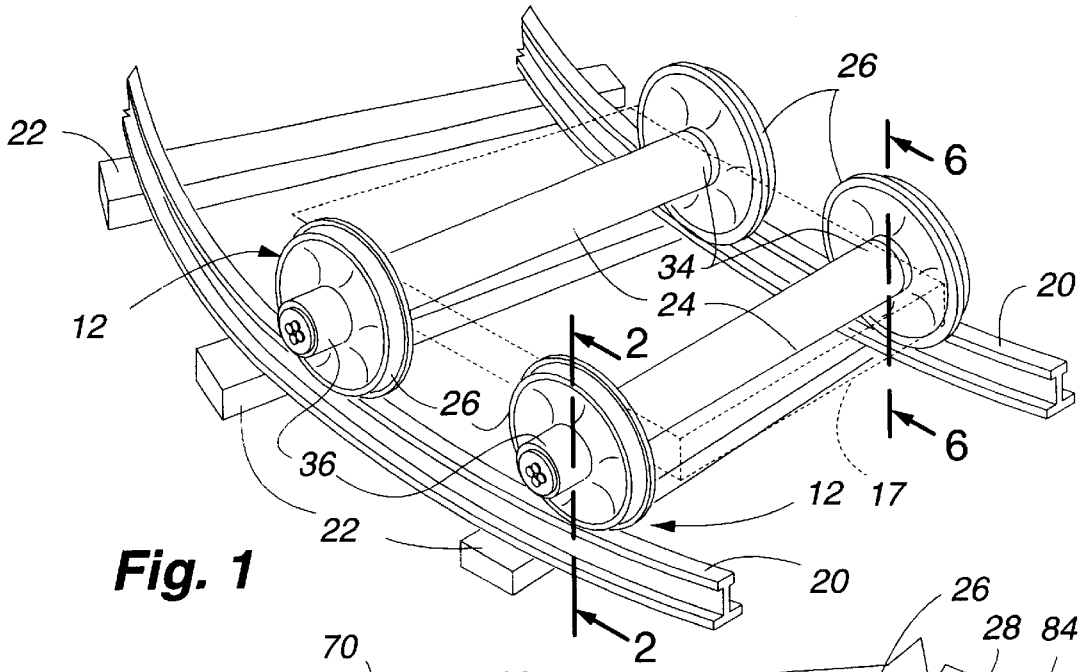
Fig. 1
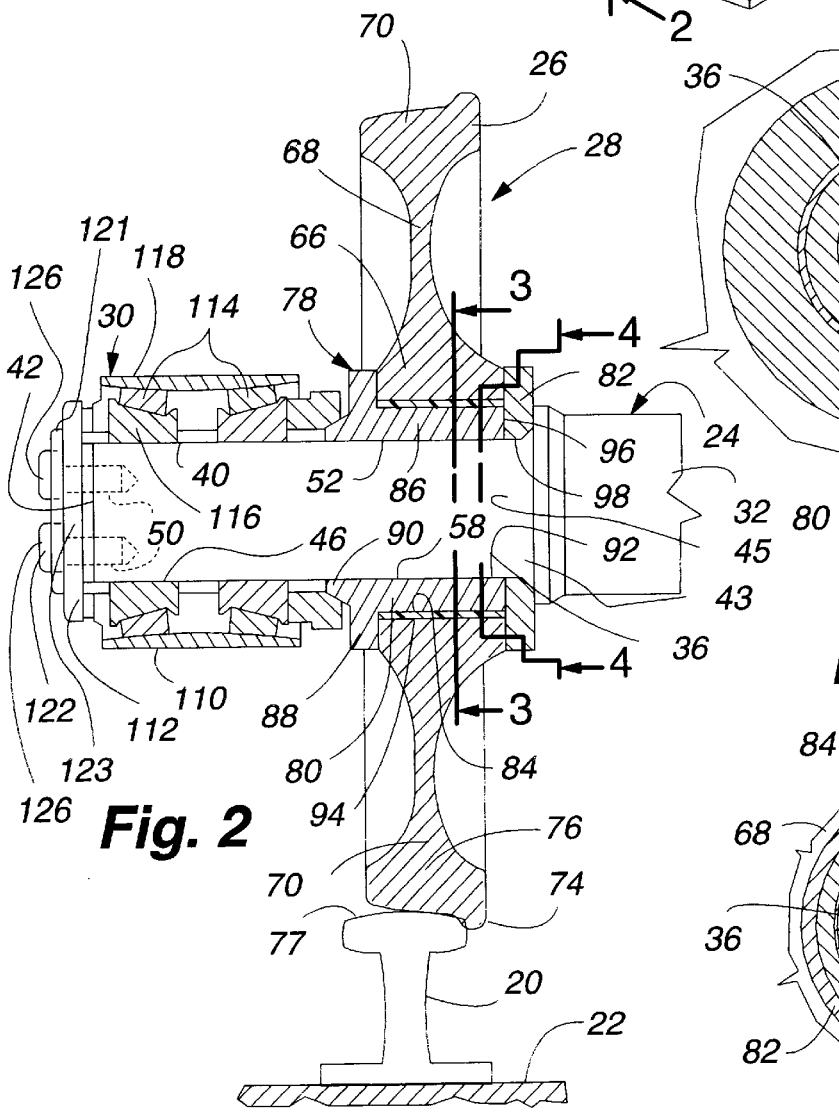
Fig. 2
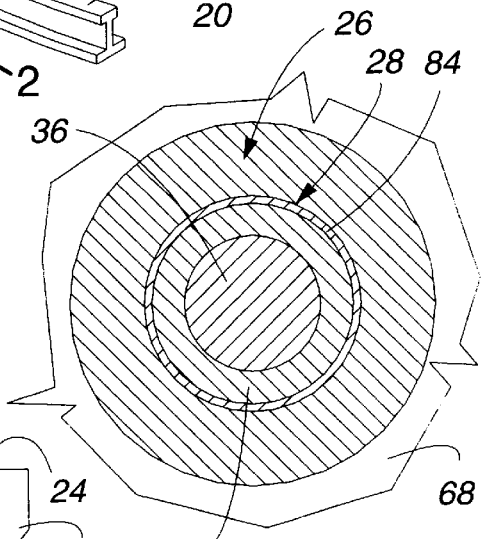
Fig. 3
Fig. 4
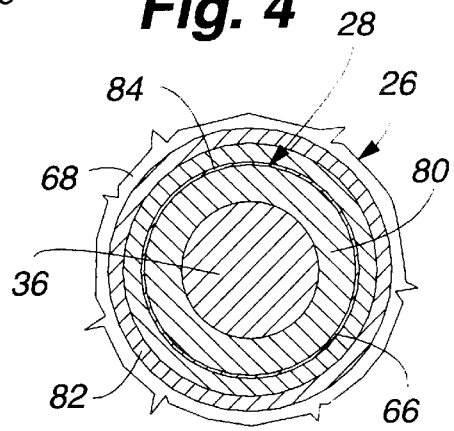

MODIFIED RAILROAD WHEEL AND AXLE ASSEMBLY

PRIOR ART

A patent search revealed the following United States patents:

| PAT. NO. | INVENTION | INVENTOR |
|---|---|---|
| 383,846 | CAR WHEEL | Horace R. Allen |
| 810,896 | FREE RUNNING WHEEL | Matt Markkula and August Rantala |
| 1,460,962 | AXLE | Seth M. Hall |
| 4,575,145 | DIFFERENTIAL AXLE FOR RAILROAD CAR | Wolfram et al |
| 4,696,506 | WHEEL SET FOR RAIL VEHICLES | Leo et al |

The Hall patent discloses one wheel member rotatable with an axle and another wheel member rotatable with an outer sleeve.

The Allen patent discloses a wheel member for a railroad car and acknowledges the problem of excessive frictional wear on rounding curves by a railroad train.

The Markkula et al patent discloses a free running wheel using an oil feeder and bearing surface to allow a wheel member to rotate to solve wear problem on railroad tracks.

The Hoffmann patent discloses a truck for railway cars being an elaborate bearing system to allow spaced railroad wheels to each turn at its own relative desired rotation.

The Wolfram et al patent discloses a differential axle for a railroad car with an axle structure having retainers on opposite sides of a rotatable wheel member.

The Leo et al patent discloses a wheel set for rail vehicles utilizing a clutch member to allow relative rotational movement between spaced railroad wheels mounted on a split axle assembly.

PREFERRED EMBODIMENT OF THE INVENTION

In one preferred embodiment of this invention, a modified railroad wheel and axle assembly is operable to replace each cooperating conventional wheel and axle assembly on a railroad car which travels along railroad rail members supported by cross tie members in a conventional manner.

The cooperating conventional wheel and axle assemblies each include a conventional wheel axle having conventional railroad wheel members secured to outer respective ends in a rigid non-rotating manner. This causes excessive wear both on the non-rotatable railroad wheel members and the railroad rail members on rounding curves which is known in the prior art.

Each modified railroad wheel and axle assembly includes 1) a railroad axle assembly which has been modified; 2) a conventional railroad wheel member mounted on one end of the railroad axle assembly; 3) a modified railroad wheel assembly secured to an opposite end of the railroad axle assembly; and 4) an axle support bearing assembly secured to each outer end of the railroad axle assembly to provide support and relative rotation to a railroad car assembly or similar structure as will be noted.

The railroad axle assembly includes a central axle section having a conventional end wheel support section on one end thereof and a modified end wheel support section on an opposite end thereof.

The conventional end wheel support section is known in the prior art and having a conventional railroad wheel member with a central hub section press fit thereon for rigid connection and not being rotatable thereon.

The modified end wheel support section is provided with a modified wheel fit section which has been machined to receive the modified railroad wheel assembly thereon as will be explained.

The modified railroad wheel assembly includes 1) a conventional railroad wheel member; and 2) a wheel retrofit assembly mounted about the modified end wheel support section of the railroad axle assembly.

The conventional railroad wheel member includes the central hub section with an opening therein and integral with a rim support section which, in turn, is integral with an outer rail contact section.

The wheel retrofit assembly includes 1) a main support retainer member of a special design to be mounted about the modified end wheel support section and having the conventional railroad wheel member mountable thereon; 2) a retainer washer member operable to engage and hold the railroad wheel member on the main support retainer member; and 3) a slip bushing member made of a nylon or Teflon material mounted about the main support retainer member. The central hub section of the railroad wheel member is mounted on the slip bushing member allowing relative rotational movement of the railroad wheel member.

The slip bushing member acts as a thin walled cylindrical bearing member which allows rotation of the railroad wheel member when rounding curves to reduce wear and tear on the subject railroad wheel member and the railroad rail members on which it is mounted in a manner to be explained.

The axle support bearing assembly is of a conventional nature having a bearing assembly mounted on outermost ends of the railroad axle assembly being held thereon by a retainer plate assembly. The bearing assembly is operable to be connected by a supporting structure (not shown) which is connected to the undersurface area of a railroad freight or the like in a known manner and not deemed pertinent to the invention herein.

OBJECTS OF THE INVENTION

One object of this invention is to provide a modified railroad wheel and axle assembly which is used to replace cooperating conventional wheel and axle assemblies on a railroad car and having a rotatable railroad wheel member mounted on a railroad axle assembly which removes unnecessary wear between the railroad wheel member and a railroad rail member on rounding curves on a railroad track.

Another object of this invention is to provide a modified railroad wheel and axle assembly having a modified end wheel support section with a conventional railroad wheel member mounted thereon through a modified railroad wheel assembly providing a slip bushing member between a railroad axle assembly and the railroad wheel member operable to allow relative rotation therebetween which reduces friction to adjacent spaced railroad rail members.

One other object of this invention is to provide a modified railroad wheel and axle assembly including a railroad axle assembly having one end presented with a machined modified end wheel support section operable to receive a wheel retrofit assembly which, in turn, receives a conventional railroad wheel member thereon and provides means of allowing relative rotation of the railroad wheel member on the modified end wheel support section to eliminate excessive wear between an outer rail contact section of the railroad wheel member and the supporting railroad rail member.

A further object of this invention is to provide a means for altering a conventional wheel and axle assembly to achieve a modified railroad wheel and axle assembly requiring a minimum amount of material and labor and only requiring the addition of a wheel retrofit assembly and machining one end of a conventional railroad axle assembly to achieve the purpose and function of this invention.

Still, one other object of this invention is to provide a modified railroad wheel and axle assembly produced from a conventional railroad wheel and axle assembly which requires a minimum amount of time, skill, and labor to do so; economical to so modify and retrofit; sturdy in construction; operable to reduce wear and, thus, required maintenance on a railroad wheel and axle assembly; and substantially maintenance free.

FIGURES OF THE INVENTION

FIG. 1 is a fragmentary schematic perspective view illustrating a couple of modified railroad wheel and axle assemblies of this invention connected to a railroad car and mounted on spaced railroad rail members;

FIG. 2 is an enlarged fragmentary sectional view taken along line 2—2 in FIG. 1;

FIG. 3 is a sectional view taken along line 3—3 in FIG. 2;

FIG. 4 is a sectional view taken along line 4—4 in FIG. 2;

FIG. 5 is an exploded perspective view illustrating the various interconnected elements used in a modified railroad wheel and axle assembly of this invention; and FIG. 6 is an enlarged fragmentary sectional view taken along line 6—6 in FIG. 1.

The following is a discussion and description of preferred specific embodiments of the modified railroad wheel and axle assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, a modified railroad wheel and axle assembly of this invention, indicated generally at 12, is shown as attached to a railroad axle assembly 24 and having outer conventional railroad wheel members 26 mounted on spaced railroad rail members 20 which, in turn, are supported on cross tie members 22 in a conventional manner. The modified railroad wheel and axle assemblies 12 are connected to a railroad car 17 of various types in a known manner.

The prior art provided a conventional wheel axle having the conventional railroad wheel members 26 mounted on opposite ends thereof in a press fit rigid non-rotating manner. This causes excessive wear on the contacting surfaces of the railroad rail members 20 and outer surfaces of the conventional railroad wheel members 26 due to rounding curves and different radius of curvature movement of the railroad wheel members 26. This problem is well known in the prior art and disclosed by many of the above noted patents as the problem of relative wear on rounding curves and, more specifically, in U.S. Pat. Nos. 383,846; 810,896; and 1,460,962. Therefore, the applicant's invention is drawn to specific structure of solving this problem by allowing a railroad wheel member 26 moving on respective railroad rail members 20 to selectively rotate on a railroad axle assembly 24.

The modified railroad wheel and axle assembly 12 includes 1) the railroad axle assembly 24 having one end modified; 2) a conventional railroad wheel member 26 press fit on one end of the railroad axle assembly 24; 3) a modified railroad wheel assembly 28 mounted on an opposite end of the railroad axle assembly 24; and 4) an axle support bearing assembly 30 connected to respective outer ends of the railroad axle assembly 24 as will be explained.

The railroad axle assembly 24 includes a central axle section 32 having a conventional end wheel support section 34 on one end thereof and a modified end wheel support section 36 on an opposite outer end thereof.

As noted in FIG. 6, the conventional end wheel support section 34 is provided with 1) a wheel fit section 38 adapted to receive a conventional railroad wheel member 26 thereon in a press fit manner; 2) a bearing fit section 40 operable to receive and support one of the axle support bearing assemblies 30 thereon; 3) an outer end wall 42 to receive a portion of the axle support bearing assembly 30 thereagainst as will be noted; and 4) a radially extended shoulder section 43.

The wheel fit section 38 has an outer wheel support surface 44 to receive and support a portion of a central hub section of the conventional railroad wheel member 26 thereon.

The bearing fit section 40 is provided with an outer bearing support surface 46 connected to the wheel fit section 38 by a bearing shoulder portion 48. The outer end wall 42 is provided with a plurality, namely four, connector holes 50 internally threaded and operable to receive anchor members therein as will be explained.

The shoulder section 43 is provided with an abutment wall 45 for reasons to be explained.

The modified end wheel support section 36 is provided with 1) a modified wheel fit section 52; 2) a bearing fit section 40; and 3) an outer end wall 42.

The modified wheel fit section 52 has been machined to reduce an outer diameter so as to receive a portion of the modified railroad wheel assembly 28 thereon as will be explained.

The bearing fit section 40, as previously described, includes the bearing support surface 46 with the bearing shoulder portion 48 removed.

The outer end wall 42 has a plurality, namely four, of the connector holes 50 therein to receive the anchor members as will be noted.

Each conventional railroad wheel member 26 includes a central hub section 66 integral with a rim support section 68 which, in turn, is integral with an outer rail contact section 70. The central hub section 66 has a central axle connector hole or opening 72 to receive the wheel fit section 38 or the modified wheel fit section 52 in the assembled condition as will be explained.

As shown in FIG. 6, the rail contact section 70 has a regular retainer portion 74 and an outer rail contact surface 76. The retainer portion 74 is operable to engage inner surfaces of the railroad rail members 20 to provide a retaining function against further outer lateral movement. The rail contact surface 76 is operable to engage a portion of a top surface 77 of the railroad rail members 20.

As noted in FIG. 2, the modified railroad wheel assembly 28 includes the conventional railroad wheel member 26 connected through a wheel retrofit assembly 78 to the modified end wheel support section 36 of the railroad axle assembly 24. The conventional railroad wheel member 26,as previously described, includes the central hub section 66 integral with the rim support section 68 which, in turn, is integral with the rail contact section 70.

The wheel retrofit assembly 78 includes 1) a main support retainer member 80 operable to be mounted, such as press fit, about the modified wheel fit section 52 of the modified end wheel support section 36; 2) a retainer washer member 82 operable to be mounted about the modified wheel fit section 52 and engageable on a portion of the conventional railroad wheel member 26; and 3) a slip bushing member 84 constructed of a nylon or Teflon material mounted between the main support retainer member 80 and the central hub section 66 of the railroad wheel member 26.

The main support retainer member 80 is provided with a central support section 86 having a wheel retainer section 88 on one end thereof and a bearing abutment section 90 on an opposite end thereof.

The central support section 86 is provided with 1) an axle contact surface 92; 2) a central bushing contact surface 94; and 3) a retainer abutment end wall 96.

The wheel retainer section 88 is extended outwardly from the central support section 86 to receive and abut a portion of the central hub section 66 of the railroad wheel member 26 to prevent movement in one direction.

As shown in FIG. 5, the retainer washer member 82 is provided with 1) a central opening 98; 2) an axle abutment surface 102; and 3) a retainer abutment surface 104.

The retainer washer member 82 contacts an opposite side of the central hub section 66 of the railroad wheel member 26 to provide a sandwiching in conjunction with the wheel retainer section 88 and the shoulder section 43 on the modified end wheel support section 36.

As noted in FIG. 5, the slip bushing member 84 is of a thin cylindrical shape being constructed of a nylon or Teflon material which acts as a lubricated bearing member. The slip bushing member 84 is provided with a wheel contact surface 106 to receive the central hub section 66 of the railroad wheel member 26 thereagainst and a retainer contact surface 108 engageable with the central bushing contact surface 94 of the main support retainer member 80.

The axle support bearing assembly 30 is respectively mounted on each respective bearing fit section 40 on outer ends of the railroad axle assembly 24. Each axle support bearing assembly 30 includes a bearing assembly 110 held on the respective outer ends of the railroad axle assembly 24 by a retainer plate assembly 112.

The bearing assembly 110 includes a plurality of roller bearing members 114 mounted within a bearing support frame 116 and surrounded by a bearing enclosure frame 118. The bearing assembly 110 is of a conventional nature having the outer bearing enclosure frame 118 secured by other structures (not shown) to the undersurface of the railroad car 17 or other similar structures in a conventional manner to allow rotation of the modified railroad wheel and axle assemblies 12 to the railroad car 17.

As shown in FIG. 5, the retainer plate assembly 112 includes a retainer assembly 120 secured by anchor members 122 to the respective connector holes 50 in the outer end walls 42 of the railroad axle assembly 24. Each retainer assembly 120 includes a pair of retainer plate members 121 and 123 having anchor holes 124 therein.

The anchor members 122 are conventional bolt members 126 which are mounted through the anchor holes 124 into the internally threaded connector holes 50 to provide anchoring thereof and to hold the bearing assembly 110 in its proper lateral location on the outer ends of the railroad axle assembly 24.

USE AND OPERATION OF THE INVENTION

In the use and operation of the modified railroad wheel and axle assembly 12 of this invention, it is noted that conventional wheel and axle assemblies are removed from their interconnection to a railroad car 17 or other similar structure. A conventional railroad wheel member 26 is removed from one end of the railroad axle assembly 24 on first removal of an adjacent outer axle support bearing assembly 30. Only one of the railroad wheel member 26 needs to be removed and replaced to construct a modified end wheel support section 36 of the railroad axle assembly 24.

More specifically, the modified end wheel support section 36 is achieved through a machining operation to remove material from an outer surface of the railroad axle assembly 24 to achieve the modified wheel fit section 52 with a reduced diameter retainer support surface 58 to receive the main support retainer member 80 of the wheel retrofit assembly 78 thereon.

The first step after producing the modified wheel fit section 52 would be to mount the retainer washer member 82 thereon into abutment with the abutment wall 45 of the shoulder section 43.

The next step would be to mount the slip bushing member 84 about the bushing contact surface 94 of the main support retainer member 80. The central hub section 66 of the railroad wheel member 26 would then be mounted on and about the slip bushing member 84 which has been mounted on the bushing contact surface 94.

Next, the assembled railroad wheel member 26 with the main support retainer member 80 having the slip bushing member 84 thereon is mounted as by press fitting about the modified wheel fit section 52 as noted in FIG. 2. The retainer abutment end wall 96 abuts a retainer abutment surface 104 of the retainer washer member 82.

The axle support bearing assembly 30 and, more particularly, the bearing assembly 110 is then mounted by press fitting about the outer end of the bearing fit section 40 of the modified end wheel support section 36 and moved inwardly to the position of FIG. 2.

Finally, the retainer plate assembly 112 with the retainer assembly 120 is mounted against the outer end wall 42 of the modified end wheel support section 36 and secured thereto by the anchor members 122 being bolt members 126 to achieve in the assembled condition of FIG. 2. This secures the bearing assembly 110 against the main support retainer member 80 which, in turn, abuts the retainer washer member 82 and the shoulder section 43 to prevent lateral movement of all the aforementioned elements.

This now presents the modified railroad wheel and axle assembly 12 on the modified end wheel support section 36 having the railroad wheel member 26 rotatable thereon by its contact with the slip bushing member 84 which acts as a bearing member.

The modified railroad wheel and axle assembly 12 now provides one railroad wheel member 26 which is rotatable about the rotating railroad axle assembly 24. This allows the relative rotation or slipping of one of the railroad wheel members 26 on rounding a curve which then substantially reduces frictional wear between the outer rail contact section

70 of the railroad wheel member 26 with its contact with an upper surface 77 of respective railroad rail members 20 to reduce maintenance and achieve longer life of the railroad rail members 20 and the railroad wheel members 26.

With all railroad wheel and axle assemblies in a railroad train assembly having the modification of this invention, the advantages would be:

1. Safety—with frictional drag eliminated, there is better stability while running through a curve;
2. Pollution—with frictional drag eliminated, there is much less noise from railroad wheel members squeaking against the railroad rail members while the railroad train assembly is running through a curve;
3. Economy—longer railroad wheel member life because frictional drag between the railroad wheel members and the railroad rail members, which causes the metal under heavy load pressure to scrub off, is eliminated;
4. Economy—longer axle life, with frictional drag eliminated while running through a curve, longer railroad axle assembly life will result because there won't be any torquing, winding up, and letting go which causes metal fatigue in the railroad axle assembly;
5. Economy—longer railroad track life because the frictional drag between the railroad rail members and the railroad wheel members, which causes the metal under heavy load pressure to scrub off, is eliminated; and
6. Economy—fuel savings because the frictional drag is eliminated while running through a curve and, thus, there is less force needed to pull the railroad train assembly through a curve.

It is noted that modification of conventional wheel and axle assemblies used on railroad cars can be readily and easily modified to achieve the modified railroad and axle assemblies of this invention. This modification is economical to achieve; easily achieved and does not require skilled labor; providing a minimum down time to achieve the modification of a conventional wheel and axle assembly; and substantially maintenance free.

While the invention has been described in conjunction with preferred specific embodiments thereof, it will be understood that this description is intended to illustrate and not to limit the scope of the invention, which is defined by the following claims:

I claim:

1. A modified railroad wheel and axle assembly, comprising:

a) a railroad axle assembly having a modified end wheel support section;

b) a modified railroad wheel assembly including a railroad wheel member connected to a wheel retrofit assembly;

c) said wheel retrofit assembly includes a main support retainer member mounted on said modified end wheel support section for conjoint rotation therewith;

d) said railroad wheel member rotatably connected to said main support retainer member;

e) said modified end wheel support section having a protruding shoulder section;

f) an axle support bearing assembly mounted on said modified end wheel support section and engageable with said main support retainer member to hold same against said shoulder section; and g) said axle support bearing assembly includes a retainer plate assembly having a retainer plate member mounted against an outer end wall of said modified end wheel support section and secured by anchor members to secure said base support retainer member with said railroad wheel member mounted thereon against said shoulder section to achieve the proper positioning thereof and prevent lateral movement of said main support retainer member with said railroad wheel member mounted thereon.

2. A wheel and axle assembly, comprising:

a) an axle assembly having an end wheel support section;

b) a support retainer member connected to said end wheel support section;

c) a wheel member rotatably mounted on said support retainer member;

d) a retainer washer member mounted on said end wheel support section and engageable with said wheel member to prevent lateral movement thereof;

e) said end wheel support section having a laterally protruding shoulder section with said retainer washer member abutting said shoulder section to achieve the proper and rigid location of said wheel member on said end wheel support section to provide the proper lateral positioning and engagement on support members to which said wheel member is being tracked thereon; and f) an axle support bearing assembly having a bearing assembly mounted on said end wheel support section and a retainer plate assembly engageable with said bearing assembly which then engages said support retainer member which is abutting said shoulder section to provide a proper positioning thereon.

3. A modified railroad wheel and axle assembly, comprising:

a) a railroad axle assembly having a modified end wheel support section;

b) a modified railroad wheel assembly including a railroad wheel member connected to a wheel retrofit assembly;

c) said wheel retrofit assembly includes a main support retainer member mounted on said modified end wheel support section for conjoint rotation therewith;

d) said railroad wheel member rotatably connected to said main support retainer member;

e) said modified end wheel support section having a protruding shoulder section;

f) an axle support bearing assembly mounted on said modified end wheel support section and engageable with said main support retainer member to hold same against said shoulder section; and g) said axle support bearing assembly includes a retainer plate assembly having a retainer plate member mounted against an outer end wall of said modified end wheel support section to secure said base support retainer member with said railroad wheel member mounted thereon against said shoulder section to achieve the proper positioning thereof and prevent lateral movement of said main support retainer member with said railroad wheel member mounted thereon.

4. A modified railroad wheel and axle assembly as described in claim 3, wherein:

a) said wheel retrofit assembly includes a slip bushing member mounted between said railroad wheel member and said main support retainer member; and b) said axle support bearing assembly having anchor members to secure said base support retainer member against said shoulder section to prevent lateral movement of said railroad wheel member.

* * * * *